US011052691B2

(12) United States Patent
Gracia Verdugo et al.

(10) Patent No.: US 11,052,691 B2
(45) Date of Patent: Jul. 6, 2021

(54) DATA COLLECTION

(71) Applicant: Hewlett-Packard Development Company, L.P., Spring, TX (US)

(72) Inventors: Antonio Gracia Verdugo, Barcelona (ES); Aleix Fort Filgueira, Sant Cugat del Valles (ES); Andreu Vinets Alonso, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/958,849

(22) PCT Filed: Jan. 8, 2018

(86) PCT No.: PCT/US2018/012845
§ 371 (c)(1),
(2) Date: Jun. 29, 2020

(87) PCT Pub. No.: WO2019/135777
PCT Pub. Date: Jul. 11, 2019

(65) Prior Publication Data

US 2021/0070078 A1 Mar. 11, 2021

(51) Int. Cl.
*B41J 2/045* (2006.01)
*B41J 29/393* (2006.01)
*B41J 2/21* (2006.01)

(52) U.S. Cl.
CPC ..... *B41J 29/393* (2013.01); *B41J 2/04505* (2013.01); *B41J 2/2135* (2013.01); *B41J 2029/3935* (2013.01)

(58) Field of Classification Search
CPC ..... B41J 29/38; B41J 2/04501; B41J 29/387; B41J 29/393; B41J 2/04555; B41J 2/14153; B41J 2/20; B41J 2/04505; B41J 2/2135; B41J 2029/3935; B41J 2/17566; B41J 2/04525; B41J 2/04526; B41J 2/0459; B41J 2/04591; B41J 2/04535; B41J 2/04558; B41J 2/04563; B41J 2/04573; B41J 2/165; B41J 2/16517; B41J 2/16579; B41J 2/195;
(Continued)

(56) References Cited

U.S. PATENT DOCUMENTS 6,331,038 B1 12/2001 Boleda et al.
8,261,259 B2 9/2012 Hattori
(Continued)

*Primary Examiner* — Kristal Feggins
(74) *Attorney, Agent, or Firm* — HP Inc. Patent Department

(57) ABSTRACT

Examples of the present disclosure relate to a calibration method for a printing system. The method comprises printing a diagnostic pattern representative of decap time. The diagnostic pattern comprises the firing of nozzles after an exposure to ambient air during a first predetermined time period to produce a first pattern element and the firing of nozzles after an exposure to ambient air during a second predetermined time period to produce a second pattern element. The method includes scanning the resulting diagnostic pattern with a sensor to collect decap data in a digital form, digitally analyzing the decap data, the digital analysis comprising identifying a quantitative difference between the first and second pattern elements, and modifying a servicing process of the printing system if the quantitative difference passes a predetermined threshold.

15 Claims, 6 Drawing Sheets

(58) Field of Classification Search
CPC ..... B41J 2/2142; B41J 2/512; B41J 2/2132; B41J 2/2139; G01N 27/10
See application file for complete search history.

(56) References Cited

U.S. PATENT DOCUMENTS

| | | | | |
|---|---|---|---|---|
| 8,287,066 | B2 | 10/2012 | Jackson | |
| 9,134,233 | B2 | 9/2015 | Taff et al. | |
| 9,844,935 | B2 | 12/2017 | Toussaint et al. | |
| 2007/0176965 | A1* | 8/2007 | Arazaki | B41J 2/2142 347/41 |
| 2007/0188821 | A1* | 8/2007 | Kojima | B41J 2/04543 358/406 |
| 2008/0036803 | A1* | 2/2008 | Yun | B41J 2/2146 347/9 |
| 2008/0074453 | A1* | 3/2008 | Furukawa | B41J 2/2142 347/14 |
| 2010/0245442 | A1 | 9/2010 | Kasai et al. | |

* cited by examiner

DATA COLLECTION

BACKGROUND

A printing system may comprise printheads for printing on a printing medium by firing a printing fluid through nozzles. The printing quality may vary over time or from printing system to printing system, potentially resulting in lower printing quality.

BRIEF DESCRIPTION OF THE DRAWINGS

Various example features will be apparent from the detailed description which follows, taken in conjunction with the accompanying drawings, wherein.

DETAILED DESCRIPTION

Figure 1A:
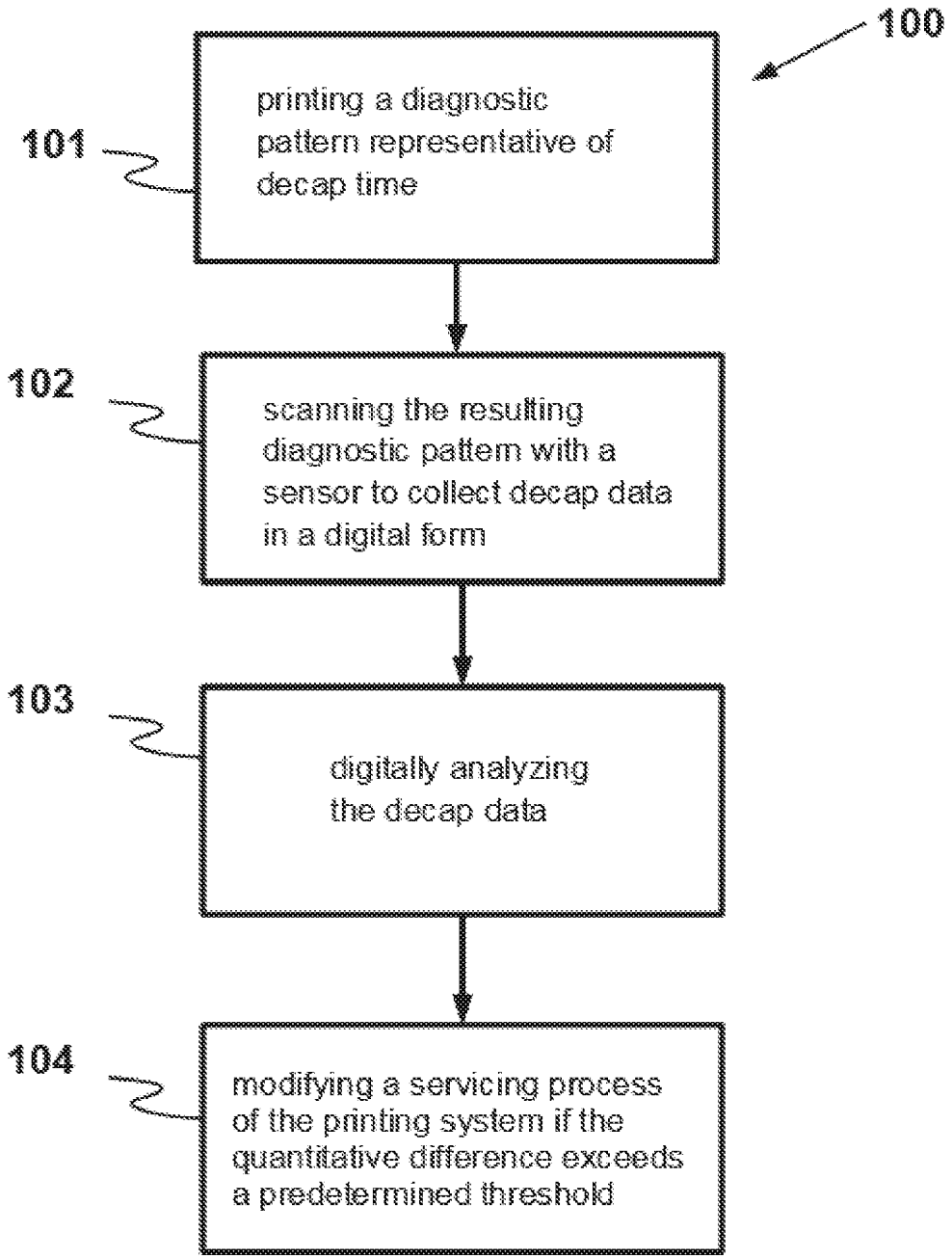
FIG. 1*a* is a block diagram of an example calibration method according to the present disclosure.

FIG. 1 illustrates an example calibration method 100 for a printing system. In an example, the printing system is an inkjet printing system. An inkjet printing system can include a fluid ejection assembly, such as a printhead assembly, and a fluid supply assembly, such as an ink supply assembly. An inkjet printing system can also include a carriage assembly, a print media transport assembly, a service station assembly, and an electronic controller. In an example, the inkjet printing system is a three dimensional (3D) printing system, for example for 3D printing on a bed of build material as a print target.

A printhead assembly can include a printhead or fluid ejection device which ejects drops of ink or fluid through a plurality of orifices or nozzles. In one example, the printing system is a thermal inkjet printing system whereby the ejection of a drop is using the heat produced by a resistor. In another example, the printing system is a piezo inkjet printing system whereby the ejection of a drop is using the mechanical energy produced by a piezo electrical element. In one example, the drops are directed toward a medium, such as a print medium, so as to print onto the print medium. A print medium includes any type of suitable sheet material, such as paper, card stock, transparencies, Mylar, fabric, and the like. In one example, nozzles are arranged in a column such that properly sequenced ejection of ink from nozzles causes characters, symbols, and/or other graphics or images to be printed upon print medium as printhead assembly and print medium are moved relative to each other.

An example ink supply assembly supplies ink to a printhead assembly and includes a reservoir for storing ink. As such, in one example, ink flows from a reservoir to a printhead assembly. In one example, a printhead assembly and an ink supply assembly are housed together in an inkjet or fluid-jet print cartridge. In another example, an ink supply assembly is separate from a printhead assembly and supplies ink to a printhead assembly through an interface connection or physical interface connection such as a supply tube.

An example carriage assembly positions a printhead assembly relative to a print media transport assembly and a print media transport assembly positions a print medium relative to a printhead assembly. Thus, a print zone is defined adjacent to nozzles in an area between a printhead assembly and a print medium. In one example, a printhead assembly is a scanning type printhead assembly such that a carriage assembly moves a printhead assembly relative to a print media transport assembly. In another example, a printhead assembly is a non-scanning type printhead assembly such that a carriage assembly fixes a printhead assembly at a prescribed position relative to a print media transport assembly.

An example service station assembly provides for spitting, wiping, capping, and/or priming of a printhead assembly in order to maintain a functionality of a printhead assembly and, more specifically, of nozzles. For example, a service station assembly may include a rubber blade or wiper which is periodically passed over a printhead assembly to wipe and clean nozzles of excess ink. In addition, a service station assembly may include a cap which covers a printhead assembly to protect nozzles from drying out during periods of non-use. In addition, a service station assembly may include a spittoon or a secondary or additional spittoon into which a printhead assembly ejects ink to insure that a reservoir maintains an appropriate level of pressure and fluidity, and help avoid that nozzles do clog or weep excessively. Functions of a service station assembly may include relative motion between a service station assembly and a printhead assembly. During operation, clogs in the printhead can be periodically cleared by firing a number of drops of ink through each of the nozzles in a process known as "spitting," with the waste ink being collected in a spittoon reservoir portion of the service station. In another example a service station comprises a web wipe where printheads are cleaned through a web of cloth. Such cloth may or may not be impregnated with a fluid participating in the cleaning process of the nozzles. An example of such fluid is low molecular weight PEG (polyethylene glycol).

An example electronic controller communicates with a printhead assembly, a carriage assembly, a print media transport assembly, and a service station assembly, Thus, in one example, when a printhead assembly is mounted in a carriage assembly, an electronic controller and a printhead assembly communicate via a carriage assembly, An example electronic controller also communicates with an ink supply assembly such that a new (or used) ink supply may be detected, and a level of ink in the ink supply may be detected. In an example, the controller is an electronic controller which includes a processor and a memory or storage component and other electronic circuits for communication including receiving and sending electronic input and output signals.

An example electronic controller receives data from a host system, such as a computer, and may include memory for temporarily storing data. Data may be sent to an inkjet printing system along an electronic, infrared, optical or other information transfer path. Data represent, for example, a document and/or file to be printed. As such, data form a print job for an inkjet printing system and include print job commands and/or command parameters.

Calibration method 100 comprises in block 101 printing a diagnostic pattern representative of decap time. For inkjet printheads and pens, "decap" arises when nozzles sit in a non-jetting state while exposed to the open atmosphere for a span of time, and subsequently receive a request to jet. As the nozzles return to actuation following such an idle period, they may display a number of non-ideal characteristics that include missing drops, mis-directed drops, weak drops, and even drops that are enriched or depleted in color compared to the bulk ink. Drops that misbehave in such manners frustrate attempts to facilitate high-quality image production.

Decap responses can be grouped into example categories. In a first example category, in pigmented ink systems, the evaporation of water from the open bores may cause the ink's pigment and the remaining vehicle in the firing chamber to self-sequester into partitioned zones. This phenomenon is referred to as pigment-ink-vehicle separation (PIVS). In another example category, the evaporation of water from the open bores may serve to increase the viscosity of ink within the jetting architecture and thereby create another decap dynamic from the formation of either in-bore or in-chamber viscous plugs.

Evaluating the decap time of nozzles in a printing system corresponds to evaluating the maximum time during which a nozzle may remain decap without having a detrimental effect on printing quality. Once the decap time of nozzles is known, printing can be optimized by balancing printing speed and printing quality. In an example, if a decap time is relatively low, nozzles should be serviced relatively often, thereby reducing printing speed to maintain quality. In an example, if a decap time is relatively low, nozzles should spit more frequently. In an example, if a decap time is relatively low, printing speed is accelerated to increase the frequency at which nozzles are spitting. In an example, if a decap time is relatively low, nozzles should spit more frequently on the fly, implying that nozzles are spitting ink in addition to the spitting built into print a print job, the additional spitting being added to reduce the time during which a nozzle is exposed to ambient air without spitting. Such additional spitting on the fly can have an impact on print quality and increase ink consumption. In an example, a printing system comprises a spit bar which permits additional spitting outside of a print job area, permitting additional printing without consequences on quality. If decap time is relatively high, nozzles can be serviced less often, thereby increasing printing speed while maintaining printing quality. If the decap time is not appropriately evaluated, either printing speed or printing quality will suffer. If the decap time taken into account in a printing process is higher than the effective decap time, nozzles will be serviced less frequently than they should, thereby affecting printing quality, for example by missing drops. If the decap time taken into account in a printing process is lower than the effective decap time, nozzles will be serviced more frequently than they should, thereby lower the printing speed. It is therefore of interest to evaluate the decap time of nozzles as precisely as possible to run a printing system at optimal quality and speed. Such an evaluation takes place in calibration method 100 by printing the diagnostic pattern.

In block 101 of FIG. 1, the diagnostic pattern comprises the firing of nozzles after an exposure to ambient air during a first predetermined time period to produce a first pattern element and the firing of nozzles after an exposure to ambient air during a second predetermined time period to produce a second pattern element. Exposing nozzles to ambient air during a predetermined time period has as a consequence that the nozzle is decapped during the time period. During either the first or the second time period, the nozzle is not capped and is not ejecting ink. In an example, the nozzle is capped until instant Td when it is decapped, and starts ejecting ink at instant Ti, whereby Td and Ti are separated by a time period equal to the respective first or second predetermined time period. In an example, the firing of nozzles comprises firing a group of nozzles, for example a primitive group. In an example, a printhead assembly includes ink ejection devices having nozzles and arranged into primitive groups, and processing electronics in communication with the ink ejection devices. The processing electronics can include logic to receive data packets for controlling the ink ejection devices. Each data packet can include primitive firing data and fire signal selection data. The processing electronics can also include logic to select, for each data packet, a fire signal for application to the primitive groups from among selectable fire signals switchable among the primitive groups based on the fire signal selection data in each respective packet. The processing electronics can also include logic to generate the selected fire signals, and to apply the selected fire signals to the ink ejection devices based on the primitive firing data for each data packet. The firing of nozzles after an exposure to ambient air permits evaluating the decap time of the printing system in function of the amount of time during which the nozzles are decapped and exposed to ambient air. Printing a first and a second pattern element allows to build the diagnostic pattern permitting the evaluation of decap.

Figure 1B:
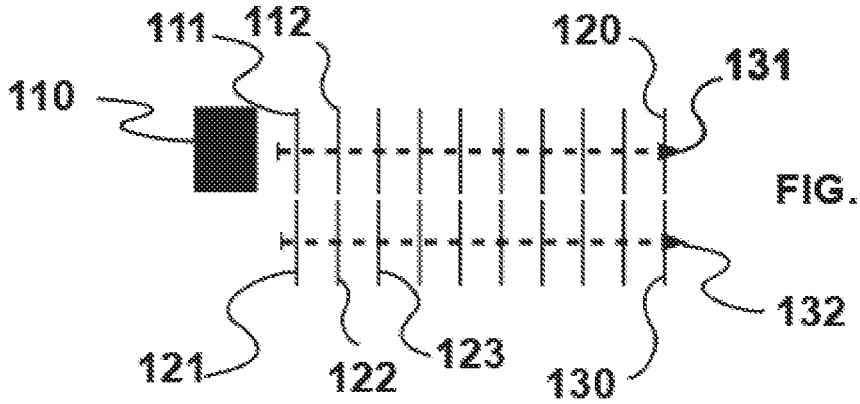
FIG. 1*b* is a schematic illustration of an example diagnostic pattern printed by the method of FIG. 1*a*.

FIG. 1*b* represents an example of printed diagnostic pattern. The diagnostic pattern of FIG. 1*b* is printed on a printed medium by nozzles comprised on a scanning printhead, the nozzles printing the pattern of FIG. 1*b* from left to right and from top to bottom. In FIG. 1*b*, the first pattern element comprises lines 111, 112, 113 and the following lines until line 120. In an example, successive lines or successive components of the diagnostic pattern such as line 111 and line 112 are separated by a distance of between 1 and 10 mm. In an example, successive lines or successive components of the diagnostic pattern such as line 111 and line 112 are separated by a distance of between 2 and 5 mm. In an example, successive lines or successive components of the diagnostic pattern such as line 111 and line 112 are separated by a distance of between 2.5 and 3.5 mm. The separation distance between successive components of the diagnostic pattern is in some examples a function of the resolution of the sensor. In this example, prior to printing the first pattern element, nozzles have printed a solid area 110. Printing the area 110 permits wetting the nozzles prior to printing the first pattern element. In this example the first pattern element is a reference pattern element which is printed with a minimal first predetermined time period. An example minimal time period is the time during which nozzles do not eject drops between area 110 and line 111 if the printhead to printing medium relative velocity is the operating velocity of the printing system, meaning that the printhead to printing medium velocity is not reduced when the nozzles travel without ejecting ink between area 110 and line 111. After printing line 120, in this example the nozzles travel to print the second pattern element. When printing the second pattern element, the nozzles first print line 121, then line 122, 123 until line 130. Prior to printing line 121, the nozzles are exposed to ambient air without ejecting ink during a second predetermined time. In this example, the second predetermined time is superior to the first predetermined time. In this example, the first pattern element is a reference pattern element whereby the nozzles are left exposed to ambient air without ejecting ink during a minimal time to print the pattern, while the second pattern element does introduce a decap time. In this case a comparison between the first and the second pattern elements permits evaluating if the decap time corresponding to the second predetermined time period has an impact on print quality. In this example, the lines of the second pattern element are corresponding to the lines of the first pattern element, which implies that the quality of printing is not affected. Arrows 131 and 132 are here for illustrative purposes to represent the area which is scanned by the sensor and are not as such part of the diagnostic pattern illustrated in FIG. 1*b*.

In block 102, the calibration method 100 comprises scanning the resulting diagnostic pattern with a sensor to collect decap data in digital form.

In an example, the sensor is a reflection densitometer which can comprise an inexpensive optical sensor that has a single light emitting diode (LED) light source at 30°, lenses and light baffles, and a photodetector IC (integrated circuit) at 0°. In another example the sensor is a three-light-source reflection densitometer or a reflection densitometer with a ring shaped mirror.

In an example, the sensor is a line sensor which measures diffuse reflectance from the surface of print media when illuminated by LED illuminants (for example: red, green, blue). The sensor can function by projecting illumination at an angle onto the paper. Light may strike the paper at the intersection of the optical axis of a central diffuse-reflectance imaging lens. A reflected illumination may be imaged onto a detector such as a light-to-voltage converter or LTV for example. An LTV can capture the diffuse component of an illumination reflectance. A source of illumination, a magnitude of detected signals and a relationship between reflectance components can provide the information to perform sensor functions.

In an example, the system comprises a sensor which is an optical sensor that detects light reflected from a page in a sequence of measurements, and a processor which is coupled to the sensor and manages the calibration operation. In some implementations, the sensor is a scan sensor which can include a combination of an illumination component and a light sensor. In operation, the illumination component illuminates print media (e.g., paper) and detects reflected light from the print media using the light sensor. In an example the sensor is embedded in the printer, for example mechanically coupled to a carriage, producing an inherent alignment between the sensor and a print head. Such alignment can be leveraged to evaluate decap regardless of variances brought on by, for example, the mounting of components of the printing system, as well as the variances which may be present with the print zone (e.g., variance within the media, stack up tolerances, height of plate and ribs, warpage of the print media, tilt of the carriage, platen droop and/or flute size). Using a sensor to scan the diagnostic pattern increases significantly the reliability of a diagnostic leading to a close estimate of the decap time of nozzles compared to using a human eye for example. Use of a sensor compared to a human eye can for example significantly improve the diagnostic when an ink color is difficult to identify in contrast with the color of the background of printing media, for example when an ink is yellow on a white sheet of paper. Use of a sensor compared to a human eye can for example significantly improve the diagnostic when detecting that a line is more fuzzy or diffused than it should be, for example due to spray or an excess of satellite drops between lines. Use of a sensor will permit increasing the precision of the diagnostic, leading to a more precise estimate of decap time, allowing a more precise calibration of a printing system, and servicing of nozzles, leading to a high printing speed and high printing quality combination.

The sensor collects decap data in that it scans the diagnostic pattern. In an example, the sensor first scans the first pattern element and then scans the second pattern element, collecting decap data in a digital form for both the first and the second pattern elements. Such data is in digital form to facilitate a subsequent analysis.

The sensor may include a non-volatile memory device on a sensor PCB with a standard communication interface with the printing system to read or write calibration data. Such memory device may store sensor calibration data during assembly. Such sensor calibration data may be related to calibrating an LED response to a special calibration patch. This process may occur in the manufacturing chain. Such memory device may allow reading sensor calibration data stored in a printer data storage. Such calibration data may be used to improve color measurement consistency and accuracy. Such a process may provide robustness against manufacturing variability of sensor, LEDs and inks.

Figure 1C:
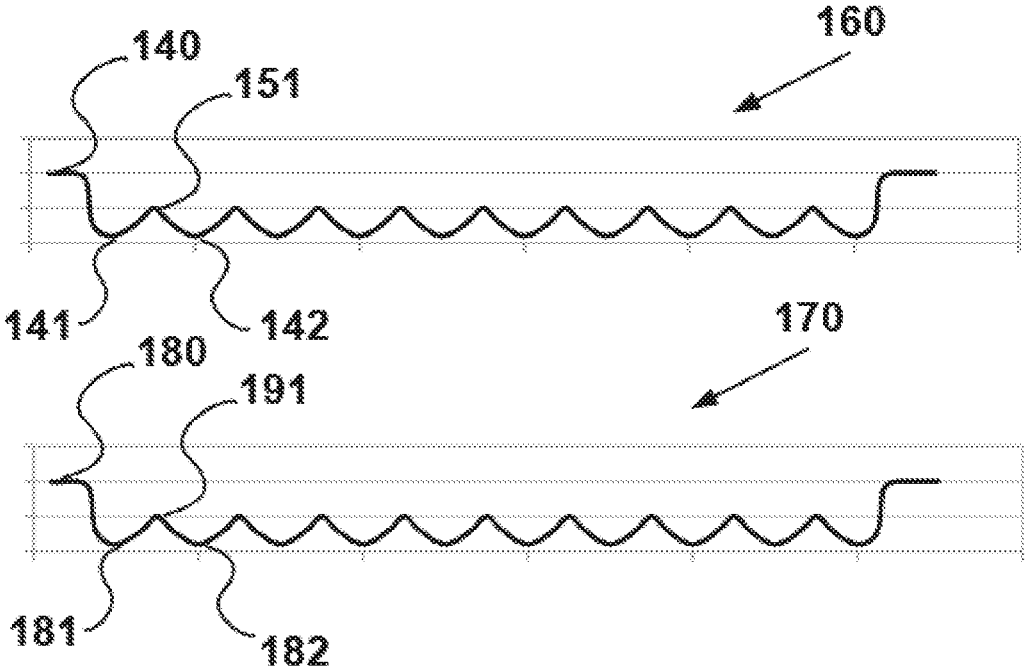
FIG. 1*c* is a schematic illustration of an example decap data analyzed by the method of FIG. 1*a*.

FIG. 1*c* depicts a schematic illustration of an example decap data analyzed by the method of FIG. 1*a*. Graph 160 is a representation of the data collected as the sensor scans the first pattern element of FIG. 1*b*. In this example, the sensor captures a number of counts proportional to the reflection on the area scanned. A number of counts can also vary in function of the sensor resolution. In an example a resolution of 150 samples or counts per inch (2.54 cm) is used. In another example, a resolution of 1200 samples or counts per inch is used. A peak in number of counts corresponds to scanning an area highly reflecting. A valley corresponds to scanning an area less reflecting. In this example, the peaks or high counts are corresponding to white areas on FIG. 1*b* while valleys or lower counts correspond to darker areas or lines on FIG. 1*b*. In this example, part 140 of graph 160 corresponds to the blank area separating printed area 110 and line 111. The graph 160 corresponds to scanning along the arrow 131 of FIG. 1*b*. Valleys 141 and 142 correspond respectively to scanning lines 111 and 112. Peak 151 corresponds to the blank area between lines 111 and 112. In this example, part 180 of graph 170 corresponds to the blank area preceding line 121. The graph 170 corresponds to scanning along the arrow 132 of FIG. 1*b*. Valleys 181 and 182 correspond respectively to scanning lines 121 and 122. Peak 191 corresponds to the blank area between lines 121 and 122. The sensor in this examples follows during scanning the same path as the nozzles during printing and goes from left to right (from valley 141 to valley 142) and top to bottom (collecting data corresponding to graph 160 prior to data corresponding to graph 170)

At block 103, the calibration method analyses the decap data, the digital analysis comprising identifying a quantitative difference between the first and the second pattern elements. In the example illustrated in FIGS. 1*b* and 1*c* a number of quantitative differences could be taken into account. For example, one could compare a count value of point 141 and of point 181, corresponding in evaluating the difference in darkness between the first and second pattern elements at the level of a corresponding first line. This would, for example, allow detecting if a line is present or not. If, for example, the second predetermined time period of the second pattern element was significantly superior to the effective decap time of the printing system, line 121 may not have been printed at all, and valley 181 would not be present, but the count would have remained in graph 170 at the same level as point 180 corresponding to an area without line. In another example, one could compare the periodicity of the peaks between the first and the second pattern elements. This could lead to detecting a quality issue if the periodicity of the peaks in graph 170 is different from the periodicity of the peaks in graph 160, particularly if the first pattern element is a reference pattern element. In another element one could compare a peak to valley height difference such as the count difference between level 141 and level 151 on one hand, and the count difference between level 181 and level 191 on the other hand. This could provide an indication as to how crisp the respective pattern elements are, whereby a higher difference of counts between peak and valley would correspond to a crisper pattern element corresponding to a higher quality level. Numerous other types of quantitative differences could be analyzed, including at statistical levels building averages over a number of lines for example or combination of various characteristics including peak height, depth of valley, breadth of peak or valley, periodicity or frequency of depth or valley, between pattern elements or within a pattern element, for example.

At block 104 the method modifies a servicing process of the printing system if the quantitative difference passes a predetermined threshold. For example, if a first line of a second pattern element is detected as missing (for example because the count collected by the sensor from the second pattern element at the level of a first line of the first pattern element is passing or exceeding a threshold corresponding to the count level 151 characteristic of an area between lines), the servicing frequency of nozzles could be increased due to detecting an impact on quality at a decap time lower than expected. Increasing service frequency would result in nozzles being services more frequently and in effectively reducing decap time.

Figure 2A:
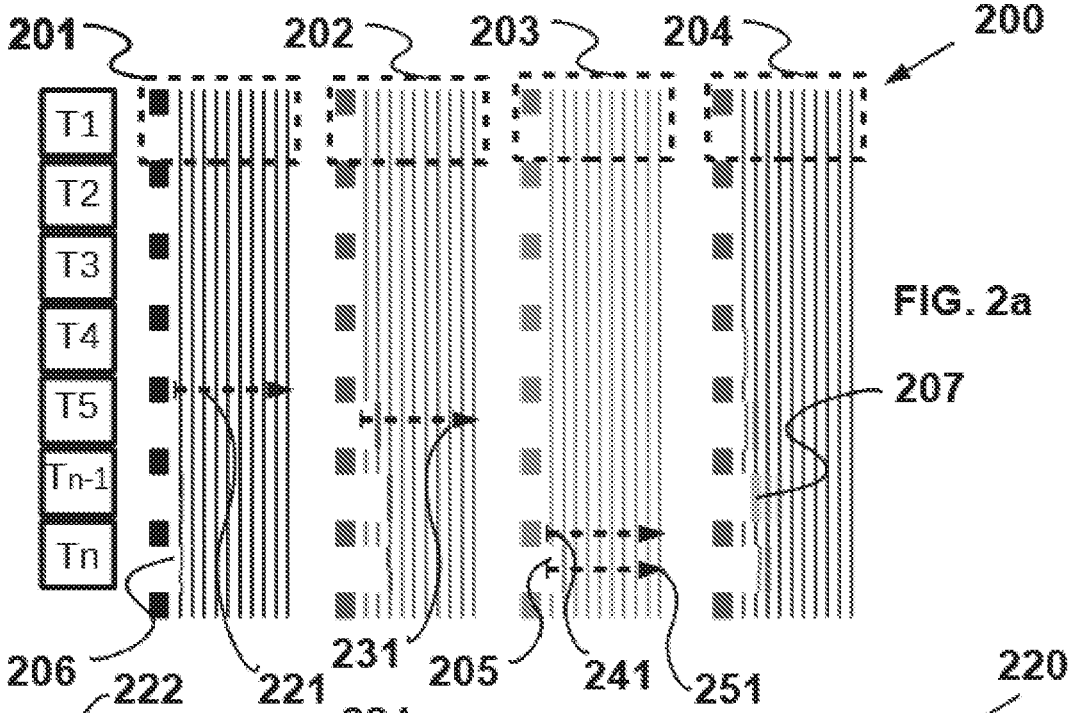
FIG. 2*a* is a schematic illustration of another example diagnostic pattern printed by the method of FIG. 1*a*.

In FIG. 2*a*, an example of a diagnostic pattern 200 according to the method of FIG. 1*b* is illustrated. In this example, the diagnostic pattern includes the first and second pattern elements of FIG. 1*b* as included in the area 201. The dashed line surrounding area 201 is not part of the printed pattern. As in FIG. 1*b*, in this example, the first pattern element is preceded by an area corresponding to area 110 of FIG. 1*b* and the first pattern element is a reference pattern element printed by firing the nozzles after an exposure to ambient air during a first predetermined time period which is a minimal time period T0 as in the case of the first pattern element of FIG. 1*b*. In an example, time T0 is the minimal time of travel for a nozzle to move between the end of area 110 and a line 111, for example 15 ms. No additional decap time is added to time period T0. In area 201, the second pattern element is printed after a second predetermined time period T1 superior to T0. T1 is included in FIG. 2*a* but is not part of the printed diagnostic pattern.

In FIG. 2*a* the diagnostic pattern includes a number of additional pattern elements, such as the pattern elements included in area 202. The elements in area 202 are corresponding to the elements in area 201 but are repeating the diagnostic pattern of FIG. 1*b* with nozzles firing inks of a different color than the ink fired by the nozzles which printed the patterns in area 201. FIG. 2*a* includes firing nozzles of yet another color in area 203, and a further color in area 204. In an example, these four colors are Cyan in area 201, Magenta in area 202, Yellow in area 203 and Black in area 204. Such a multicolor diagnostic pattern permits calibrating several colors simultaneously.

Such pattern elements are reproduced using different predetermined time periods T2, T3, T4, T5 to Tn. In this example, for each predetermined time period and corresponding pattern element, a reference pattern element is printed with a predetermined time period T0, preceded by an area such as area 110 of FIG. 1*b*. Including printing a reference pattern prior to each different predetermined time period T1 to Tn permits comparing each respective pattern element with the corresponding reference. Including areas such as area 110 ensures that nozzles are wet prior to printing each the reference pattern. In this example, T1 is superior to T2, T2 is superior to T3, progressively increasing until Tn. In other words, in the additional firing of nozzles after an exposure to ambient air during additional time periods T2 to Tn to print additional pattern elements of the diagnostic pattern, the first, second an additional time periods are increasing progressively. In an example, T0 is 0 seconds (meaning that the nozzles are printing the line corresponding to line 111 of FIG. 1*b* without any delay after printing the area 110, except for the time of travel between finishing area 110 and line 111), T1 is 0.3 second, T2 is 0.6 second, T3 is 0.9 second, increasing progressively by intervals of 0.3 seconds until T10 at 3 seconds. In an example, the increasingly progressing predetermined time periods increase following a geometric progression. In an example, the increasingly progressing predetermined time periods increase following an arithmetic progression, for example with a difference of 0.5 seconds between the terms of the sequence.

In an example, the first predetermined time period is of less than 1 second, and the second predetermined period is of more than 1 second. In an example, the first predetermined time period is of less than 0.5 second, and the second predetermined period is of more than 1 second. In an example, the first predetermined time period is of less than 0.1 second, and the second predetermined period is of more than 0.3 second. In an example, the first predetermined time period is of less than 0.5 second, and the second predetermined period is of more than 0.5 second. In an example, the first predetermined time period is of less than 0.2 second, and the second predetermined period is of more than 0.4 second.

One can for example observe in FIG. 2*a* that the Yellow ink pattern remains consistent with the reference pattern until Tn, whereby the first line is missing in area 205. Such a missing line in area 205 implies that a decap time of Tn for Yellow ink does have a quality impact, and that the nozzles ejecting Yellow ink should be serviced or be fired with a frequency such that they would not be left uncapped for a time Tn or longer.

One also can observe in FIG. 2*a* that the Cyan ink pattern very progressively evolves as the predetermined time period increases from T1 to Tn, whereby the first lines progressively get misaligned with their corresponding line in the reference pattern, for example in the case of line 206. Such a progressive evolution is difficult to appreciate with the human eye, but would clearly be detected with the sensor when scanning in block 102.

One can also observe in FIG. 2 that lines can become fuzzy, or less crisp, for example in the case Black ink pattern line 207. Again, this is a sign of lower quality printing due to nozzles remaining decapped during a relatively long time, in this case during a time Tn−1. Again, detection of fussiness will be greatly improved using a sensor when compared to an evaluation with the human eye.

Figure 2B:
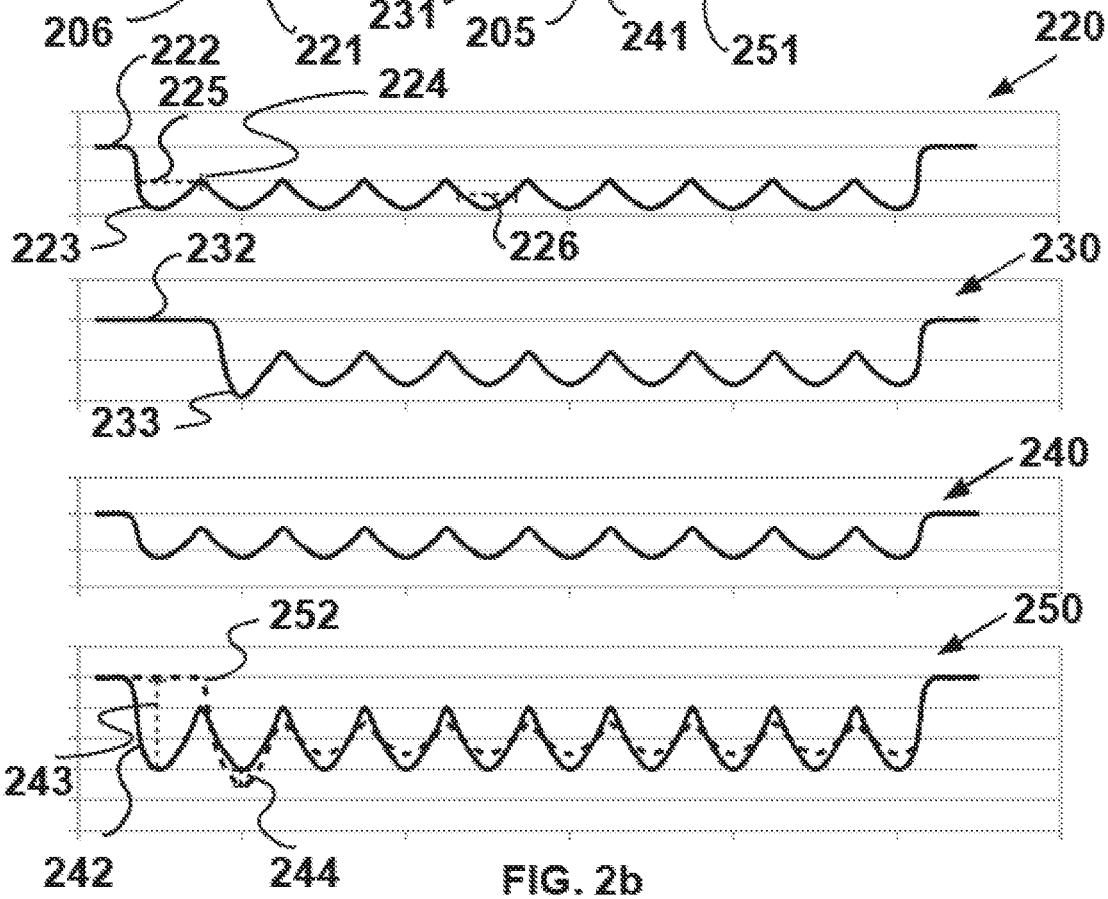
FIG. 2*b* is a schematic illustration of another example decap data analyzed by the method of FIG. 1*a*.

In FIG. 2*b*, four graphs are represented, each graph corresponding to data collected by the sensor. Graph 220 corresponds to the scanning of the sensor along arrow 221 of FIG. 2*a*. Graph 230 corresponds to the scanning of the sensor along arrow 231 of FIG. 2*a*. Graph 240 corresponds to the scanning of the sensor along arrow 241 of FIG. 2*a*. Graph 250 comprises a first curve 242 in solid line corresponding to the scanning of the sensor along arrow 241 of FIG. 2*a* (i.e. the same curve as the one represented in 240, but at a different scale) and, in a dashed line, a curve 252 corresponding to the scanning of the sensor along arrow 251.

In FIG. 2*b*, graph 220 corresponds to a scan of a pattern element which results from scanning an area without ink situated prior to the first line, such area corresponding to a high sensor output level 222. This is followed by a valley 223 which corresponds to the detection of the first line of the pattern element. The valley is followed by 9 other valleys corresponding to the remaining 9 lines of the pattern element, each valley being separated from the next by a peak such as peak 224 for example. In an example, the level of sensor counts for point 222 is of about 1000 counts, the level of sensor counts for point 223 is of about 200 counts, the level of sensor counts for point 224 is of about 500 counts. In the example, peak 224 is not at the same level as the plateau level 222 because the sensor has a capture area, the capture area being for example substantially circular, the capture area including a portion of consecutive lines of the pattern element when scanning a peak such as 224.

Moving to graph 230, one can observe that the plateau section 232 is longer than plateau section 222, and that 9 and not 10 valleys are appearing. This is due to the fact that the corresponding pattern element 231 scanned is missing the first line, due to nozzles firing magenta ink being affected by a long T5 predetermined time period being decapped, such that the first line could not be printed, possibly due to dry ink pigment preventing ink ejection. One can also observe that the valley 233 is at a level lower than the following 8 valleys, possibly due to the corresponding line being fuzzy, also due to the excessive time during which the nozzles were left decapped. In an example, the sensor count corresponding to the deepest point of valley 233 is of 100 counts.

As per these example, the diagnostic pattern includes a plurality of lines, whereby the digital analysis comprises detecting if a line is missing and detecting if a line is fuzzy. In such an example, each line is a component of the diagnostic pattern. In other examples, components of other shapes may be considered, such as substantially circular or round components, substantially rectangular or square components, or other shapes including polygonal shapes. In further examples, the diagnostic pattern can include in a single pattern components of various shapes.

In such examples, the decap data represents a succession of peaks and valleys, the digital analysis comprising a measurement of a characteristic breadth and depth of the peaks and valleys. For example, the depth of valley 233 compared to the plateau 232 is of about 900 counts. For example, the depth of valley 223 compared to the plateau 222 is of about 800 counts. Characteristic breadth of valley 223 may be corresponding to the length of a segment 225 intersecting peak 224 and the slope between plateau 222. Another characteristic breath measurement for a valley may be the breadth of the valley at mid depth or at another predetermined depth, meaning for example at 50% or at another predetermined percentage of the height between the bottom of the valley and a neighboring peak, illustrated by measuring the length of segment 226.

Moving to graph 250, an example of collected decap data for a first and a second pattern element is represented. An example of a quantitative difference is the distance 243 separating curves 242 and 252 at the point corresponding to the first line of the first pattern element illustrated by curve 242. In this example, the difference is of about 800 sensor counts. If a predetermined threshold of for example 100 sensor count is defined to detect the absence of a line, a quantitative difference of 800 would exceed the threshold. Passing a threshold can occur by exceeding or by falling below the threshold value. In this case, the threshold is considered passed when it is exceeded. In this same graph, quantitative difference can be taken into account as a difference 244 in valley depth, such a difference in valley depth corresponding to detecting a fuzzy line. In this example, the peak to valley distance of the valleys of 252 following valley 244 is lower than the peak to valley distance of 242, 242 being in an example a reference pattern element. In an example, a peak to valley distance of 25 sensor counts is a predetermined threshold, in that the threshold is considered passed and the servicing is for example rendered more frequent if the quantitative difference is of less than 25 sensor counts. Such lower peak to valley distance may be associated with increased line fuzziness. Such quantitative differences are identified and analyzed according to block 103 to method 100.

Figure 3:
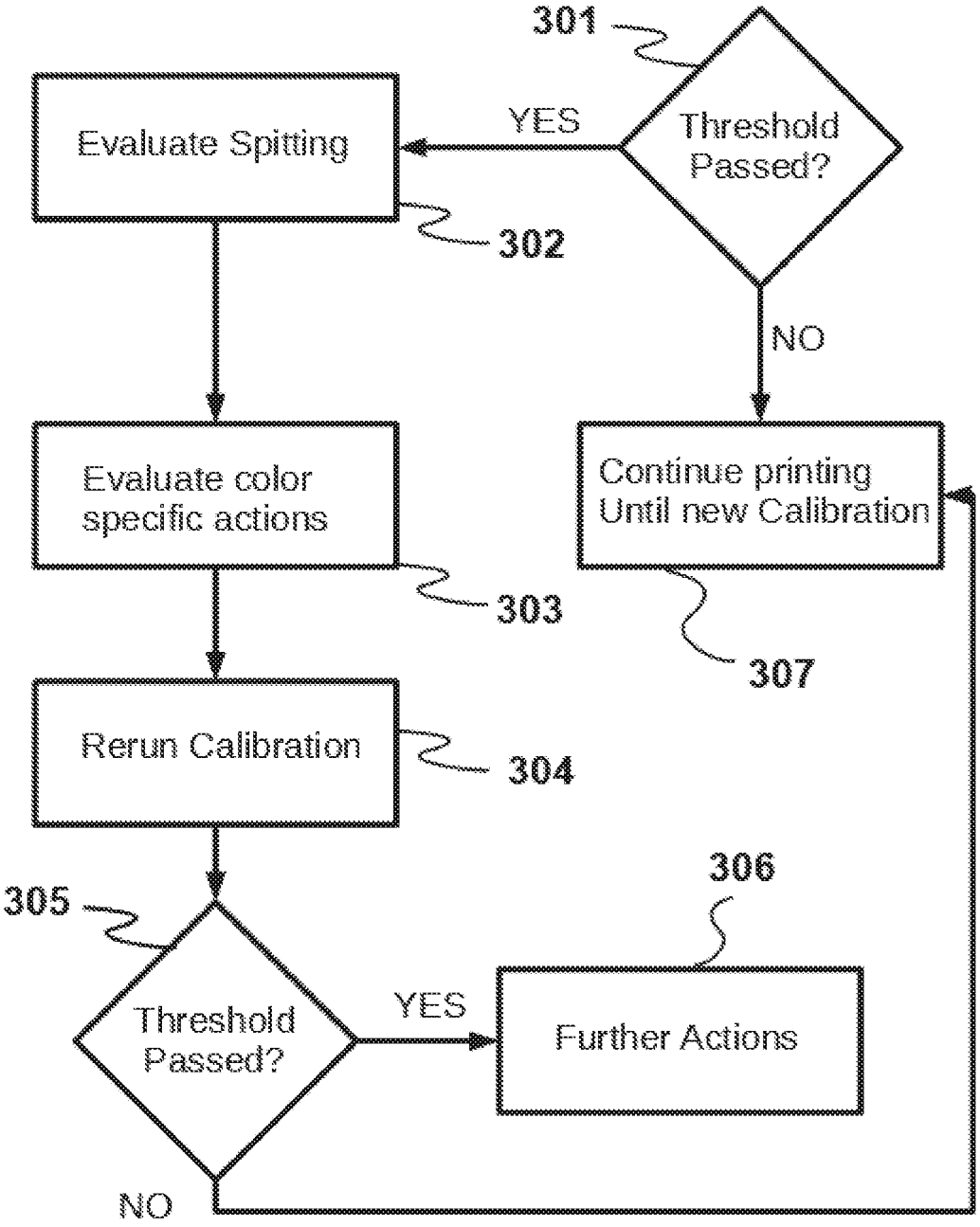
FIG. 3 is a block diagram of an example modification of a servicing process by the method of FIG. 1*a*.

According to block 104 of method 100 of FIG. 1, if the quantitative difference passes a predetermined threshold, a servicing process of the printing system is modified. An example of modifying a servicing process is represented in FIG. 3. At block 301, a test is made as to whether a predetermined threshold was passed by the quantitative difference. If such threshold was not passed, the printing system continues printing and operating normally until a further calibration takes place. Calibration may be triggered every so often, manually or in an automated manner. When occurring in an automated manner, it may be triggered after a predetermined period of time, after a predetermined quantity of ink consumed by the printing system, after a predetermined quantity of prints or after a predetermined quantity of printing medium consumed, for example.

In some examples, more than one quantitative difference is identified, and a servicing process is modified if one or a plurality of predetermined threshold is passed by a respective quantitative difference.

If at block 301 the threshold was passed, in an example spitting procedures are evaluated. In an example, the threshold is passed is the quantitative difference is above a threshold. In another example, the threshold is passed if the quantitative difference is below a threshold. Spitting settings can be changed to a higher frequency, for example in relation to the amount for which the threshold was passed. For example, nozzle spitting frequency could be raised by 5% if the threshold is passed by 5%, and nozzle spitting frequency could be raised by 10% if the threshold is passed by 10%. Spitting settings can be changed to for example increase the number of drops spitted in relation to the amount for which the threshold was passed. For example, if the threshold is passed by a given percent amount, the number of drops spitted could be raised by the same or by a proportional or formulaically linked percent amount.

In the example of FIG. 3, color specific actions may be considered at block 303. For example, if a color is more susceptible to decap issue than another, for example due to the nature of the composition of the ink, the color and associated printhead or part of printhead may be assigned a secondary additional spittoon for example. In an example, the servicing process is color specific, and a color less susceptible of decap issues and maintaining quality levels with higher decap time then other colors are assigned lighter servicing. In an example, block 303 is followed by rerunning a calibration at block 304, itself followed by testing whether a threshold was passed or not. If the threshold is not passed, the printing system is considered as having validated the calibration and moves to block 307, continuing printing operations normally until a new calibration takes place. In an example, the threshold applied at block 305 is different from the threshold applied at block 301.

If following block 305 a threshold is passed, it is possible that the actions taken at blocks 302 and 303 have not been sufficient to resolve an issue of decaping and that further actions should be taken in block 306. Such further actions could for example include alerting a user, processing the decap data further through additional analysis, comparing the decap data with past decap data to detect trends or system drifts, suggest further actions, suggesting the modification of an image placement, or continue printing until a further calibration takes place.

Figure 4A:
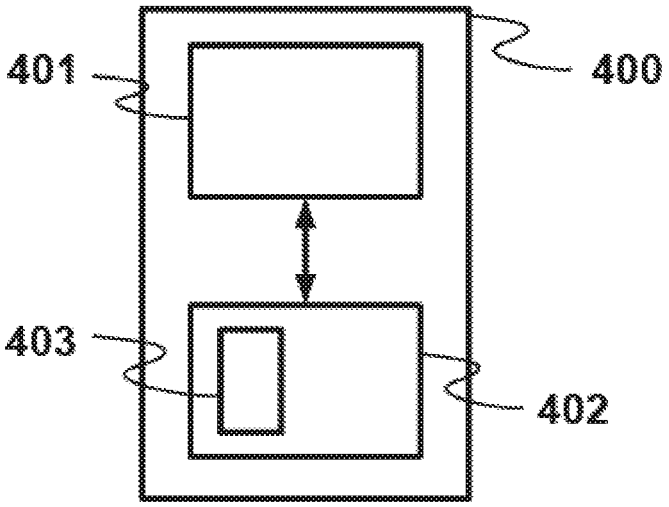
FIG. 4*a* is a block diagram of an example printing system calibration controller according to the present disclosure.

FIG. 4*a* illustrates a printing system calibration controller. The controller 400 comprises a processor 401. The processor 401 performs operations on data. In an example, the processor is an application specific processor, for example a processor dedicated to printer calibration, or to printing. The processor may also be a central processing unit. In an example, the processor comprises an electronic logic circuit or core and a plurality of input and output pins for transmitting and receiving data.

The controller 400 comprises a storage 402. Data storage may include any electronic, magnetic, optical, or other physical storage device that stores executable instructions. Data storage 402 may be, for example, Random Access Memory (RAM), an Electrically-Erasable Programmable Read-Only Memory (EEPROM), a storage drive, an optical disk, and the like. Data storage 402 is coupled to the processor 401.

The controller 400 comprises an instruction set 403. Instruction set 403 cooperates with the processor 401 and the data storage 402. In the example, instruction set 403 comprises executable instructions for the processor 401, the executable instructions being encoded in data storage 402.

The instruction set 403 cooperates with the processor 401 and the storage 402 to fire nozzles after an exposure to ambient air during a first predetermined time period to produce a first pattern element and fire nozzles after an exposure to ambient air during a second predetermined time period to produce a second pattern element. The instruction set 403 also cooperates with the processor 401 and the storage 402 to operate a printer embedded sensor to scan the pattern elements; collect data from the sensor in a digital form; analyze the collected data to identify a quantitative difference between the first and the second pattern elements; and service the nozzles if the quantitative difference passes a predetermined threshold.

Figure 4B:
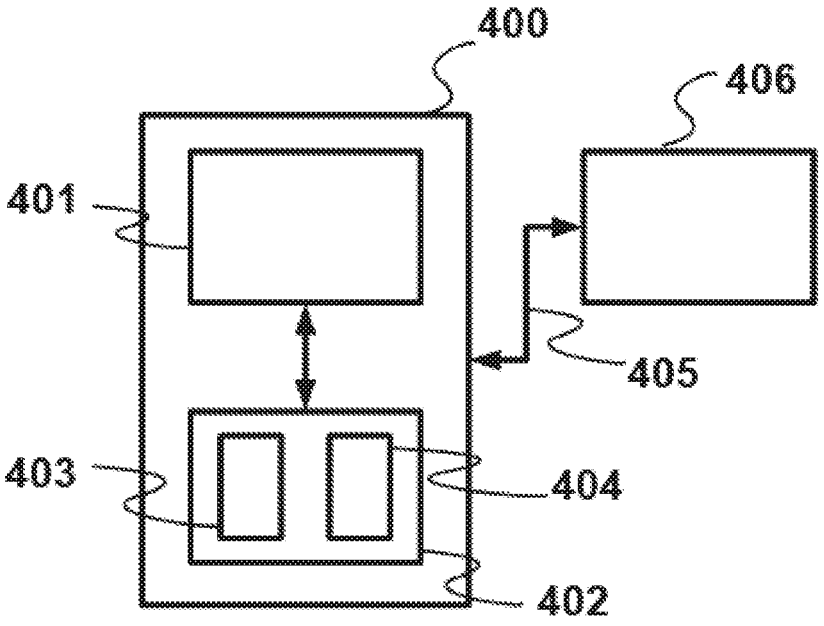
FIG. 4*b* is a block diagram of another example printing system calibration controller according to the present disclosure.

In an example represented in FIG. 4*b*, the instruction set 403 further cooperates with the processor and the storage to store collected data over time and to compare collected data to past collected data. The collected data stored over time may be stored in a partition 404 of storage 402. In this example, the instruction set 403 further cooperates with the processor and the storage to send information related to the collected data through a network 405 to a multi printer management system 406.

Collecting and storing data over time allows accumulating past of historical decap data from calibration and to possibly determine or detect trends or long term evolution of decap characteristics. This can apply do a single printer, whereby one could for example detect that a decap evolves and changes in function of ambient conditions, for example ambient temperature, ambient humidity, or exposure to light or direct sunlight. Decap characteristics may also change in function of the printing medium used or of the ink used. Storing and monitoring decap data over time can allow to fine tune the servicing process of a printer to optimize it in view of such changing conditions. Such trends may evolve in a continuous or in a discontinuous fashion over time. Transmitting such data over a network to a multi printer management system can permit controlling or optimizing the use of a multi printer environment such as a print farm. Such trends can lead to predicting potential issues with printers which have not encountered such issues yet, and permit avoiding such issues for example through an update of instructions stored in a storage medium.

In an example, the instruction set 403 further cooperates with the processor and the storage to propose modifying an image placement if the quantitative difference exceeds another threshold. Modifying and image placement may for example have an impact on nozzle health if the image to print is elongated, having a length and a width, the length being longer than the width. In an example, it is proposed to align the length of such an image with a scanning direction of a printhead. In this manner nozzles could print substantially continuously along the length of the image, printing the image in a number of swaths lower than if the width of such an image is aligned with a scanning direction of a printhead.

Figure 5:
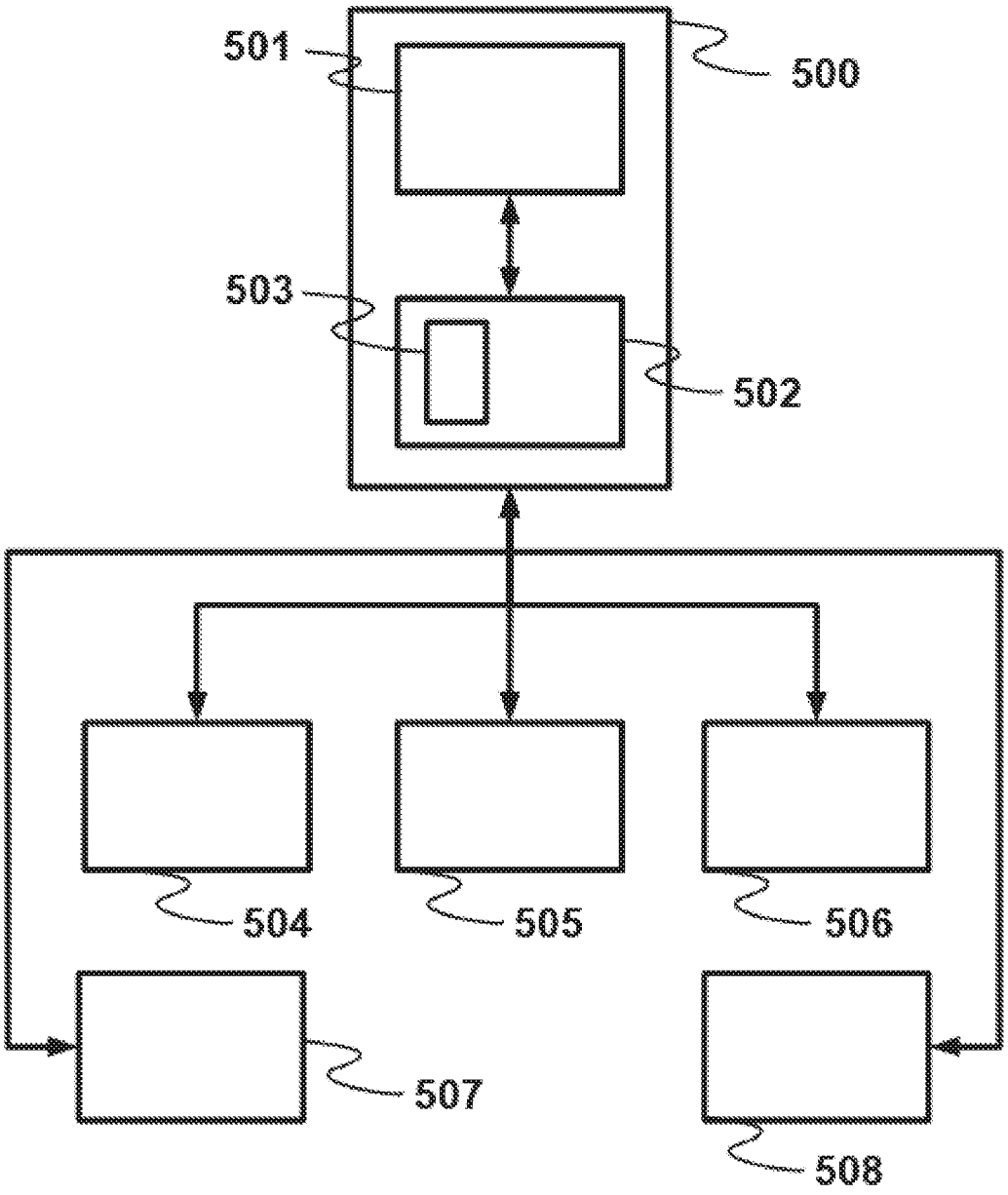
FIG. 5 is a block diagram of a multi printer management system according to the present disclosure.

In FIG. 5, an example of a multi printer management printer 500 is illustrated, the system comprising a processor 501, a storage 502 coupled to the processor, and an instruction set 503 to cooperate with the processor 501 and the storage 502 to collect decap data from multiple printers 504, 505, 506, 507 and 508; the decap data comprising, for each printer 504, 505, 506, 507 and 508, a decap value representative of a decap characteristic of the printer 504, 505, 506, 507 and 508; and statistically analyze the decap data to detect a trend.

As examples, the printers comprised in the multiple printers may be located on a local network, or on a remote network, or on different networks or on a combination of these. Such printers comprised in the multiple printers may be provide decap data to be collected over different periods of time and different geographies.

In an example, the decap value representative of a decap characteristic is a specific time at which decap introduces quality issues for the respective printer. In an example, the decap value representative of decap is an average over time of specific times at which decap introduces quality issues for the respective printer. In an example, the decap value representative of decap is relates to a specific color or ink for the respective printer. In an example, the decap value representative of decap comprises multiple values, for example including average or ink specific values. The decap characteristic may be related to for example a number of missing lines or missing pattern components in a diagnostic pattern. The decap characteristic may be related to for example a number of fuzzy lines or fuzzy pattern components in a diagnostic pattern.

A statistical analysis of trends comprises in an example detecting an increasing trend of decap value representative of a decap characteristic. A trend may develop itself for example over time, or for example over a specific printer population, or for example over ink types. A decreasing decap value may also be detected, for example suggesting a positive nozzle health impact which could be for example linked to a change in ambient conditions of to a change of ink. Such statistical analysis of trends may use statistical tools such as comparing a trend to a theoretical trend, detecting an underlying pattern or behavior which would otherwise be partly or nearly hidden by noise. Such data treatment may lead to an update of instructions encoded in a storage medium or to a change of ink for example.

In an example, the instruction set 503 is to cooperate with the processor 501 and the storage 502 to recommend modified servicing processes if the trend indicates that an average decap value passes a pre-determined servicing trend threshold.

In an example, the instruction set 503 is to cooperate with the processor and the storage to recommend a change of ink if the trend indicates that an average decap value passes a pre-determined ink change trend threshold.

In an example, the instruction set 503 is to cooperate with the processor and the storage to group the printers in different classes in function of printer attributes, whereby the trend is detected on a per class basis. Example of printer attributes include the type of printer, ambient conditions, the type of printhead, the type of ink, the type of media, the manufacturing lot of a media or other consumable such as ink, other printer attributes or a combination of these.

The preceding description has been presented to illustrate and describe certain examples. Different sets of examples have been described; these may be applied individually or in combination, sometimes with a synergetic effect. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A calibration method for a printing system comprising:
printing a diagnostic pattern representative of decap time, the diagnostic pattern comprising
the firing of nozzles after an exposure to ambient air during a first predetermined time period to produce a first pattern element and;
the firing of nozzles after an exposure to ambient air during a second predetermined time period to produce a second pattern element;
scanning the resulting diagnostic pattern with a sensor to collect decap data in a digital form;
digitally analyzing the decap data, the digital analysis comprising identifying a quantitative difference between the first and second pattern elements;
modifying a servicing process of the printing system if the quantitative difference passes a predetermined threshold.

2. A calibration method according to claim 1, whereby the first predetermined period is of less than 1 second, and whereby the second predetermined period is of more than 1 second.

3. A calibration method according to claim 1 comprising the additional firing of nozzles after an exposure to ambient air during additional time periods to print additional pattern elements of the diagnostic pattern, the first, second and additional time periods increasing progressively.

4. A calibration method according to claim 1, whereby the diagnostic pattern is repeated with nozzles firing inks of different colors.

5. A calibration method according to claim 4, whereby the servicing process is color specific.

6. A calibration method according to claim 1, whereby the diagnostic pattern includes a plurality of lines and whereby the digital analysis comprises detecting if a line is missing and detecting if a line is fuzzy.

7. A calibration method according to claim 1, whereby the decap data represents a succession of peaks and valleys, the digital analysis comprising a measurement of a characteristic breadth and depth of the peaks and valleys.

8. A printing system calibration controller comprising a processor, a storage coupled to the processor, and an instruction set to cooperate with the processor and the storage to:
fire nozzles after an exposure to ambient air during a first predetermined time period to produce a first pattern element;
fire nozzles after an exposure to ambient air during a second predetermined time period to produce a second pattern element;
operate a printer embedded sensor to scan the pattern elements;
collect data from the sensor in a digital form;
analyze the collected data to identify a quantitative difference between the first and the second pattern elements; and
service the nozzles if the quantitative difference passes a predetermined threshold.

9. A printing system calibration controller according to claim 8, the instruction set to cooperate with the processor and the storage to store collected data over time and to compare collected data to past collected data.

10. A printing system calibration controller according to claim 8, the instruction set to cooperate with the processor and the storage to send information related to the collected data through a network to a multi printer management system.

11. A printing system calibration controller according to claim 8, the instruction set to cooperate with the processor and the storage to propose modifying an image placement if the quantitative difference passes another threshold.

12. A multi printer management system, the system comprising a processor, a storage coupled to the processor, and an instruction set to cooperate with the processor and the storage to:
collect decap data from multiple printers, the decap data comprising, for each printer, a decap value representative of a decap characteristic of the printer; and
statistically analyze the decap data to detect a trend.

13. A multi printer management system according to claim 12, whereby the instruction set is to cooperate with the processor and the storage to recommend modified servicing processes if the trend indicates that an average decap value passes a pre-determined servicing trend threshold.

14. A multi printer management system according to claim 12, whereby the instruction set is to cooperate with the processor and the storage to recommend a change of ink if the trend indicates that an average decap value passes a pre-determined ink change trend threshold.

15. A multi printer management system according to claim 12, whereby the instruction set is to cooperate with the processor and the storage to group the printers in different classes in function of printer attributes, whereby the trend is detected on a per class basis.

* * * * *